US007207161B2

(12) United States Patent
Belmann et al.

(10) Patent No.: US 7,207,161 B2
(45) Date of Patent: Apr. 24, 2007

(54) APPARATUS FOR BANDEROLING OR BANDING STACKS OF FLAT WORKPIECES

(75) Inventors: Markus Belmann, Kornwestheim/Pattonville (DE); Udo Ganter, Freiberg am Neckar (DE)

(73) Assignee: Heidelberger Druckmaschinen AG, München (DE)

( * ) Notice: Subject to any disclaimer, the term of this patent is extended or adjusted under 35 U.S.C. 154(b) by 46 days.

(21) Appl. No.: 11/063,177

(22) Filed: Feb. 22, 2005

(65) Prior Publication Data

US 2005/0183398 A1 Aug. 25, 2005

(30) Foreign Application Priority Data

Feb. 20, 2004 (DE) ..... 10 2004 008 469

(51) Int. Cl.
*B65B 13/04* (2006.01)

(52) U.S. Cl. ..... 53/589; 53/399; 100/26

(58) Field of Classification Search ..... 53/582, 53/589, 588, 399, 580, 591; 100/25, 26
See application file for complete search history.

(56) References Cited

U.S. PATENT DOCUMENTS

| | | | | |
|---|---|---|---|---|
| 3,213,780 | A * | 10/1965 | Neitzel et al. | 100/4 |
| 3,483,817 | A | 12/1969 | Stobb | |
| 3,572,604 | A * | 3/1971 | Reth et al. | 242/363 |
| 3,834,297 | A * | 9/1974 | Huson | 100/3 |
| 3,977,314 | A * | 8/1976 | Tanaka | 100/4 |
| 4,408,438 | A * | 10/1983 | Rewitzer | 53/438 |
| 4,566,378 | A * | 1/1986 | Fleissner | 100/26 |
| 4,625,635 | A * | 12/1986 | Lewis | 100/26 |
| 4,836,873 | A * | 6/1989 | Mitanihara et al. | 156/157 |
| 5,309,695 | A * | 5/1994 | Frabetti et al. | 53/136.1 |
| 5,379,687 | A * | 1/1995 | Moseley | 100/3 |
| 5,755,083 | A * | 5/1998 | Cleine | 53/588 |
| 5,755,084 | A | 5/1998 | Dekker | |
| 5,806,279 | A * | 9/1998 | Spatafora | 53/399 |
| 5,842,327 | A * | 12/1998 | Schwede | 53/540 |
| 5,890,423 | A | 4/1999 | Lih | |
| 6,279,898 | B1 | 8/2001 | Stephan | |
| 6,484,476 | B2 * | 11/2002 | Yamamoto et al. | 53/399 |
| 6,516,592 | B1 * | 2/2003 | Kimmerle | 53/589 |
| 6,711,883 | B2 * | 3/2004 | Schwede et al. | 53/589 |
| 2002/0026773 | A1 * | 3/2002 | Shibazaki et al. | 53/582 |

FOREIGN PATENT DOCUMENTS

| | | |
|---|---|---|
| DE | 196 15 009 A1 | 10/1997 |
| DE | 101 43 839 A1 | 3/2003 |
| EP | 0 640 529 B1 | 3/1995 |
| EP | 1 151 948 A1 | 11/2001 |

* cited by examiner

*Primary Examiner*—Stephen F. Gerrity
*Assistant Examiner*—Paul Durand
(74) *Attorney, Agent, or Firm*—Laurence A. Greenberg; Werner H. Stemer; Ralph E. Locher

(57) ABSTRACT

An apparatus for forming stacks of flat workpieces and for banding or banderoling the stacks includes a stacking station, a banding or banderoling station, and an endless conveyor for cyclically conveying stacking shafts provided to the endless conveyor. A respective first band guide is formed on a respective one of the stacking shafts and a second band guide is disposed in the banding station. The second band guide together with the respective first band guide form an at least approximately intrinsically closed guide path.

7 Claims, 5 Drawing Sheets

APPARATUS FOR BANDEROLING OR BANDING STACKS OF FLAT WORKPIECES

BACKGROUND OF THE INVENTION

Field of the Invention

The invention relates to an apparatus for banderoling or banding stacks of flat workpieces.

An apparatus disclosed in European Patent EP 0 640 529 B1 for banderoling or banding stacks of flat workpieces includes a stationary stacking shaft having a liftable and lowerable shaft base, a belt conveyor filling the stacking shaft with respective copies of printed products and a band supply roller disposed in front of and behind the stacking shaft. The band supply roller has bands which are welded to one another in the region of the stacking shaft and are accordingly guided in one piece from one band supply roller over the base of the shaft to the other band supply roller. The base of the shaft is lowered a distance corresponding to the increase in the height of a stack being formed thereon. In that regard, the band located with one section under the stack and on the base of the shaft rests on an end face facing downstream with respect to the conveying direction of the belt conveyor and on an upstream-facing end face of the stack being formed. After the intended height of the stack has been attained, an auxiliary carrying device temporarily accommodating the copies supplied to the stacking shaft is moved into the stack forming area. The band from the end face of the stack facing upstream and from the end face of the stack facing downstream is respectively pushed by a welding bar over the upper side of the stack until the latter is strapped or tied. In that regard, two sections of the band are disposed in mutual contact under the action of a respective one of the welding bars and are welded to one another in that position by the welding bar. A two-layer welded section of the band which is consequently presented is severed so that the stack is strapped by a closed band, and the remaining band once more extends in one piece from one band supply roller to the other.

During the strapping of the stack having an intended height, the welding of the band and the removal of the banded stack from the shaft base, the auxiliary carrying device brought temporarily into the stack-forming area performs the function of the shaft base and transfers that part of the next stack to be formed, which is formed during the aforementioned procedures and accommodated by the auxiliary carrying device, and the section of the band located underneath the stack again to the shaft base once more positioned in the vertical position thereof.

A given amount of time is required in order to move the aforementioned auxiliary carrying device into the stack forming area. In the heretofore known auxiliary carrying device, the flat workpieces accumulating during that time period are temporarily backed up on the aforementioned belt conveyor.

In order to complete a banded stack, the heretofore known device requires a time period that is made up of the time necessary for piling up a stack of a specific number of copies and the time necessary for banderoling or banding the stack.

A time period that is shortened with respect thereto is required with a small package delivery system which has been marketed under the designation type PAS 66 by Heidelberger Druckmaschinen A.G., Heidelberg, Germany. That device has a stacking station, a banderoling or banding station and a cyclically conveying endless conveyor provided with stacking shafts. A band supply extends in one piece (after suitable welding has been performed) from a first supply roller to a second supply roller and, as opposed to the device known from the hereinafore-mentioned European Patent EP 0 640 529 B1, in such a manner that an unwound band section runs in a plane that is perpendicular to the conveying plane of the endless conveyor.

SUMMARY OF THE INVENTION

It is accordingly an object of the invention to provide an apparatus for banderoling or banding stacks of flat workpieces, which overcomes the hereinaforementioned disadvantages of the heretofore-known devices of this general type and which has an alternative band guidance and a cycle time that at most insignificantly exceeds the stack forming period.

With the foregoing and other objects in view, there is provided, in accordance with the invention, an apparatus for forming stacks of flat workpieces and for banding or banderoling the stacks. The apparatus comprises a stacking station, a banding or banderoling station and an endless conveyor for cyclically conveying stacking shafts provided to the endless conveyor. A respective first band guide is formed on a respective one of the stacking shafts and a second band guide is disposed in the banding station. The second band guide together with the respective first band guide form an at least approximately intrinsically closed guide path.

In accordance with another feature of the invention, the apparatus further includes a reversible injection device associated with the banding or banderoling station. During operation, the injection device injects an end section of a band into a respective stacking shaft located in the banding or banderoling station.

In accordance with yet another feature of the invention, the apparatus further includes a clamping, welding and cutting station associated with the banding or banderoling station. A free end of the injected end section is to be clamped in the clamping, welding and cutting station for reversed operation of the injection device.

In accordance with a further feature of the invention, the second band guide is aligned at least approximately in a conveying direction of the endless conveyor.

In accordance with an added feature of the invention, the second band guide includes a floating nozzle configuration.

In accordance with an alternative feature of the invention, the second band guide includes a suction belt drive.

In accordance with a concomitant feature of the invention, the apparatus includes an auxiliary stack carrier temporarily movable over a respective one of the stacking shafts.

Thus, by providing an auxiliary stack carrier movable temporarily or momentarily between two successive flat workpieces over a respective one of the stacking shafts, a cycle time is obtained which is at least approximately limited to the stack forming time.

This is also true of the case wherein, instead, a given number of the continuously accumulating flat workpieces are temporarily or momentarily backed up on the conveyor loading these workpieces in the apparatus according to the invention, in a manner analogous to the heretofore-known apparatus described in the introduction hereto.

Other features which are considered as characteristic for the invention are set forth in the appended claims.

Although the invention is illustrated and described herein as embodied in an apparatus for banderoling or banding stacks of flat workpieces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
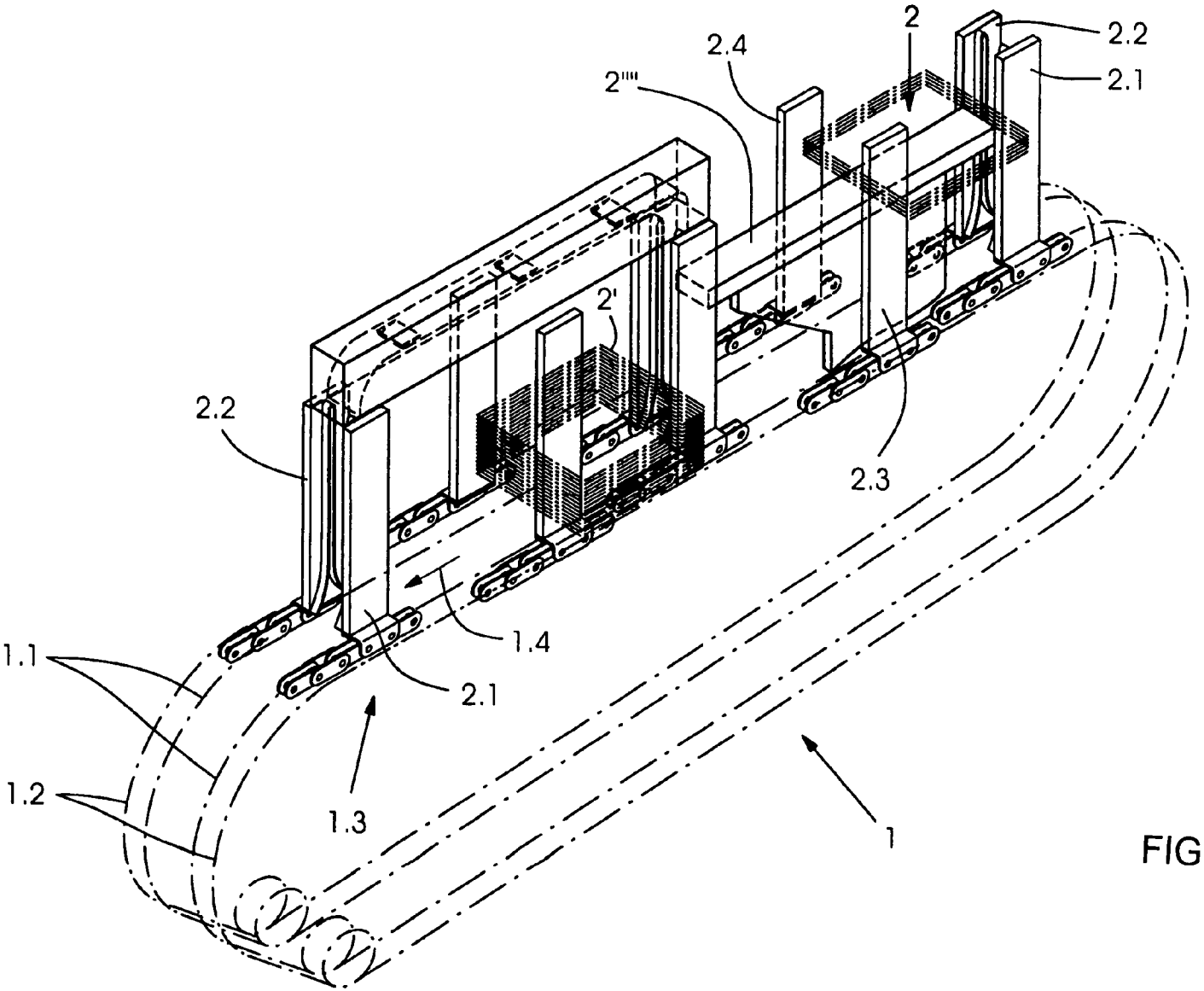
FIG. 1 is a diagrammatic, top, front and side perspective view of a plurality of stacking shafts disposed successively on a cyclically revolving endless conveyor represented in phantom.

Referring now to the figures of the drawings in detail and first, particularly, to FIG. 1 thereof, there is seen an apparatus for banderoling or banding flat workpieces 2'. The apparatus includes an endless conveyor 1 preferably having a first pair of flexible drives 1.1 and a second pair of flexible drives 1.2. Specifically, in the illustrated exemplary embodiment, the drives are in the form of a first and a second pair of endless roller chains which, together with suitable sprockets 1.5 (shown in FIG. 2), form a multiple chain drive. The two pairs of flexible drives 1.1 and 1.2 form a conveying section 1.3 of mutually parallel conveying strands preferably lying in a single surface and, during operation, moving cyclically in a conveying direction represented by an arrow 1.4.

Stacking shafts 2 are disposed on the endless conveyor 1, following one another along the latter. A respectively trailing boundary of the stacking shafts 2 is formed by rear stops 2.1 and 2.2, and a respectively leading boundary of the stacking shafts 2 is formed by front stops 2.3 and 2.4, as seen in the conveying direction. The rear stops 2.1 and 2.2 are fixed to the first pair of flexible drives 1.1, specifically in such a way that they are disposed opposite one another transversely with respect to the conveying direction, and preferably follow one another at equal intervals in the conveying direction, which then determine the largest possible format of the flat workpieces that can be stacked. The mutual position of the rear stops 2.1 with respect to the rear stops 2.2 is also adjustable by the mutual phase angle of the flexible drives of the first pair of flexible drives 1.1.

The front stops 2.3 and 2.4 are fixed to the second pair of flexible drives 1.2 in an analogous manner.

The stacking shafts 2 are adjustable to specific formats of the flat workpieces 2' by setting specific mutual phase angles of the first pair of flexible drives 1.1, on one hand, and of the second pair of flexible drives 1.2, on the other hand. A driving device 3, which is diagrammatically represented in FIG. 2, moves the aforementioned multiple chain drives and, therefore, the stacking shafts 2, cyclically in the conveying direction represented by the arrow 1.4 in FIG. 1. This advantageously results in the possibility of performing the operations of stack formation and of banding or banderoling at different locations, so that these operations can proceed simultaneously following the formation of a first stack 2". For this purpose, during operation, the endless conveyor 1 conveys a respective one of the stacking shafts 2 cyclically into a stacking station P and then in a conveying direction represented by the arrow 1.4 into a banding or banderoling station B which is only generally indicated in FIG. 2. In this case, a respective stack 2" built up in the stacking station P is carried by a support 2'" which is formed, for example, by revolving belts or stationary guides spaced apart from one another transversely with respect to the conveying direction 1.4 (note FIGS. 3 and 5).

It is believed to be readily apparent that the stacking shafts 2 are conveyed from the stacking station P into the banding or banderoling station B only when a stack 2" which has a specific number of flat workpieces 2' has been piled up in the stacking station P if, thereafter, accumulating flat workpieces 2' are temporarily intercepted and the stack 2" has contact between the underside thereof and the endless conveyor. Such contact can be broken during the stack formation if, as preferably provided, the stack 2" is piled up on a stack table 2"" which is liftable and lowerable (note FIG. 1).

Figure 2:
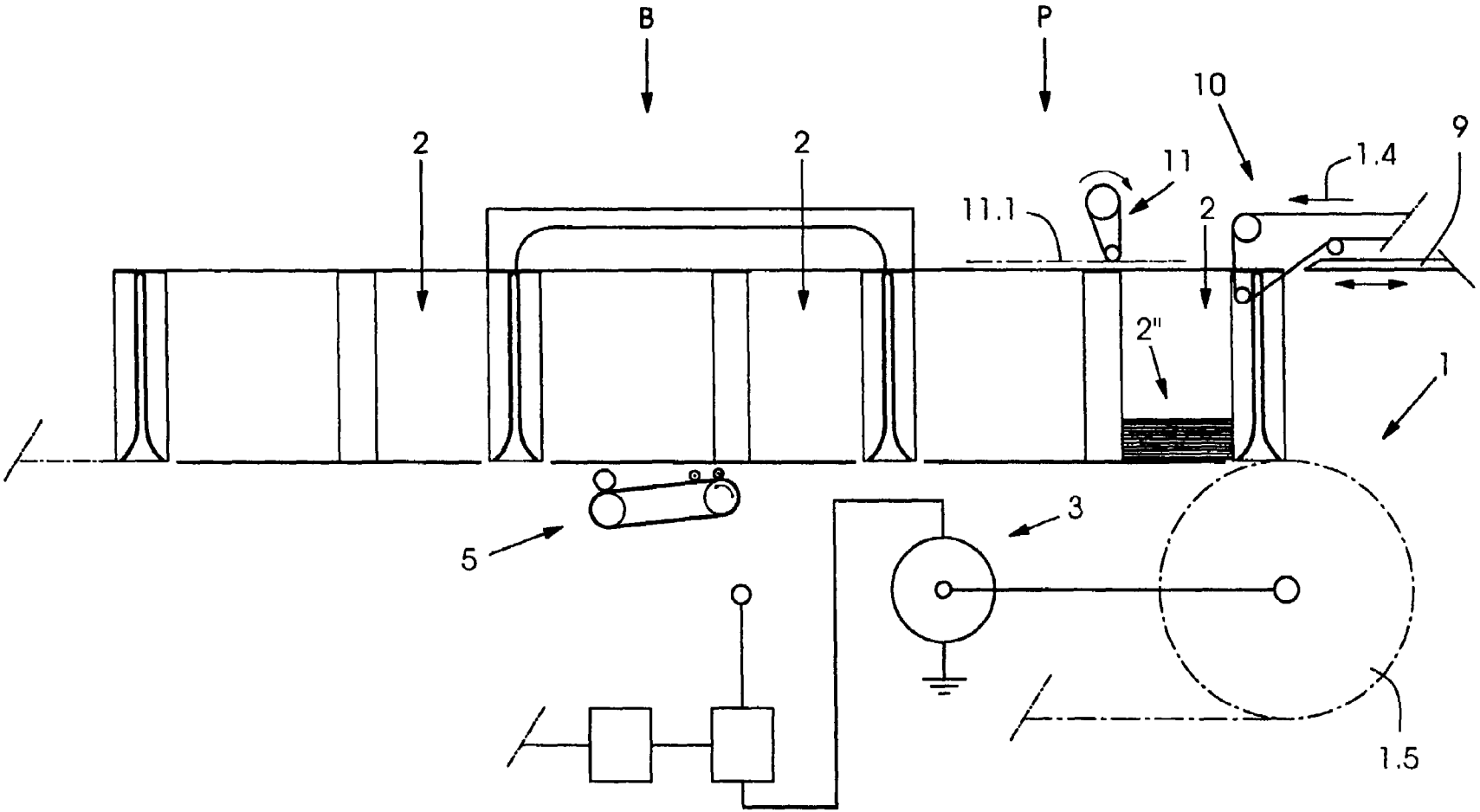
FIG. 2 is a simplified side-elevational view of a section of the endless conveyor equipped with stacking shafts, a driving device therefor, a device for loading flat workpieces in a stacking shaft in a stacking station, and an injection device associated with a banderoling or banding station for inserting a section of a band into a respective stacking shaft located in the banding station.
Figure 3:
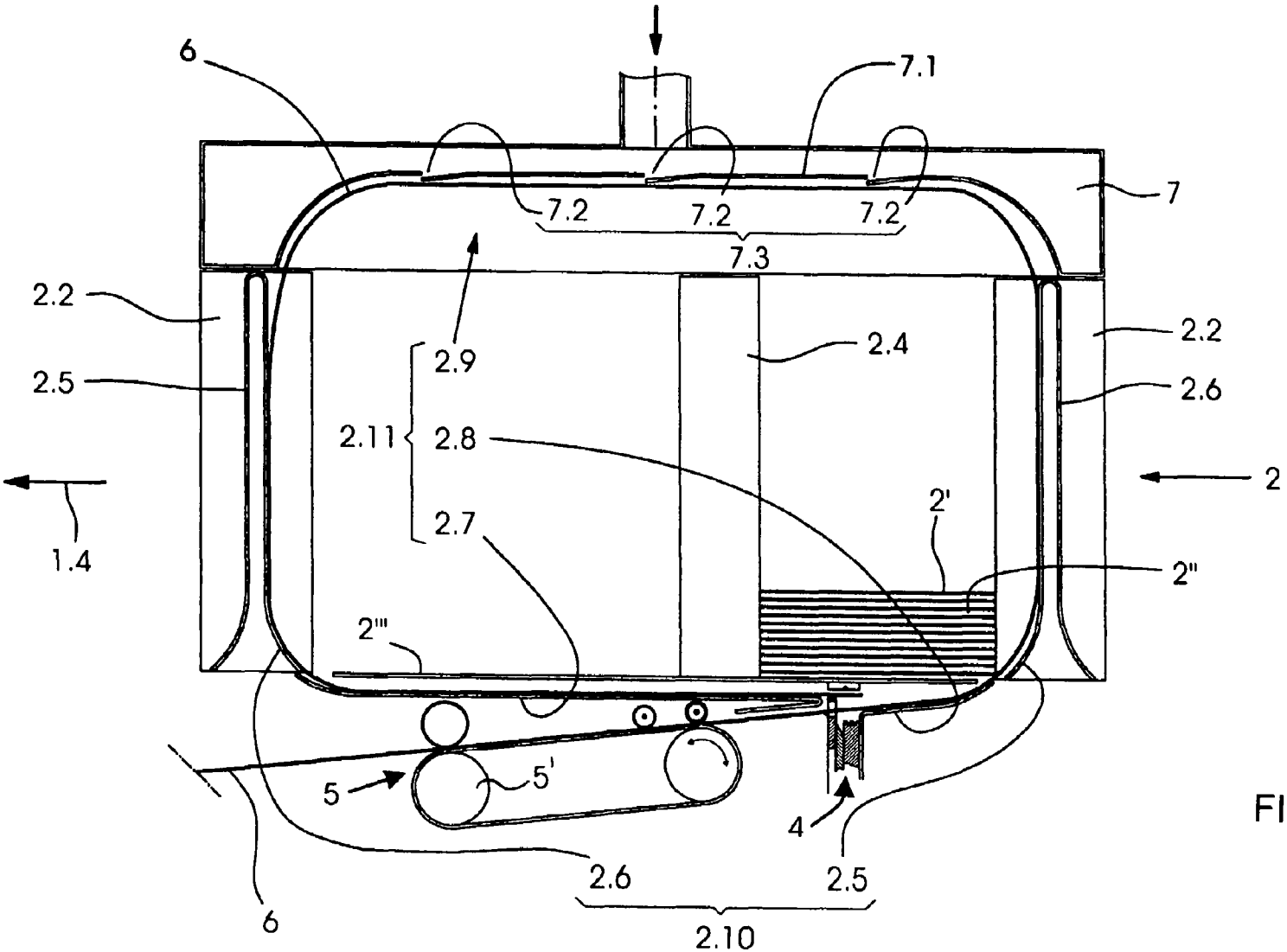
FIG. 3 is an enlarged, fragmentary, side-elevational view of a portion of FIG. 2 showing a stacking shaft located in the banding or banderoling station, a first band guide formed therein and a stationary second band guide which, together with the first band guide, form an intrinsically closed guide path of a first configuration, and a welding and cutting station associated with the banding or banderoling station.

FIG. 3 shows one of the stacking shafts 2 in a position thereof in the banding or banderoling station B, omitting the endless conveyor 1. The view of FIG. 3 corresponds to a section drawn between the roller chains of the first pair of flexible drives 1.1 in a plane perpendicular to the axes of the sprockets 1.5 (note FIG. 2) and, as is also believed to be apparent in FIG. 1, reveals a first band guide 2.10 formed on the stacking shafts 2 and a second band guide 2.11 disposed in the banding or banderoling station B, which are aligned at least approximately in and respectively counter to the conveying direction represented by the arrow 1.4. The first band guide 2.10 in the exemplary embodiment of FIG. 3 includes a first guide section 2.5 and a second guide section 2.6. The guide sections 2.5 and 2.6 are oriented at least approximately perpendicularly and are disposed in such a manner that, in the vicinity of one and the same rear stop 2.1 and/or 2.2, a first guide section 2.5 and a second guide section 2.6 are respectively disposed. The first guide section 2.5 has a guide surface directed in the conveying direction represented by the arrow 1.4, and the second guide section 2.6 has a guide surface directed counter to the conveying direction 1.4. In this regard, the guide surface directed in the conveying direction 1.4 is, in any event, set back with respect to a stop surface formed on the respective rear stops 2.1 and 2.2 for aligning the stack 2".

The second band guide 2.11, having lower guide sections 2.7 and 2.8 and an upper guide section 2.9, together with the first band guide 2.10, forms an at least approximately or substantially intrinsically or fundamentally closed guide path. In particular, on the upper guide section 2.9 of the guide path as well, precautions which are explained below in greater detail are taken, to the effect that an end section of a band 6 injected into a stack shaft 2 in the banding or banderoling station B initially rests on all of the guide sections 2.5 to 2.9. To this extent, a respective stack 2" is initially loosely strapped by the end section of the band 6 by injecting a band section always having the same length, measured on usual dimensions of the stack 2". The aforementioned length is dimensioned in such a way that the leading end of the injected end section reaches a clamping, welding and cutting station 4 (note FIGS. 3 and 5). The injection is performed by a reversible injection device 5 which is associated with the banding or banderoling station B and, in the illustrated exemplary embodiment, preferably includes a belt drive 5' and pressure rollers cooperating therewith (note FIGS. 3 and 5).

The injected end section is a free end of a wound band supply which is not illustrated herein.

For the purpose of injection, the belt drive 5' revolves clockwise in the illustrated exemplary embodiment, and the band 6 located between a delivery strand of the belt drive 5' and the aforementioned pressure rollers is injected into the interior of the stacking shaft 2 through a gap formed between the lower guide sections 2.7 and 2.8. In this regard, the entry direction in the illustrated exemplary embodiment is opposite to the conveying direction represented by the arrow 1.4.

In an alternative construction, an injection device is provided which injects the band 6 into the stacking shaft 2, for example by clamping the band 6 between upper and lower belts of a belt drive configuration.

FIGS. 4A to 4F show individual phases of the banding or banderoling operation and, respectively, illustrate the clamping, welding and cutting station 4. In order to carry out the banding or banderoling operation, an anvil 4.1 is inserted beneath the support 2'", transversely with respect to the conveying direction represented by the arrow 1.4 (note FIGS. 1 and 3) and, after the banding or banderoling operation has been completed, is again withdrawn from the welding and cutting station 4.

The aforementioned, always constant, length of the injected end section of the band 6 is also dimensioned in such a way that the leading end of the band 6 extends at least approximately over the cross-sectional width of the anvil 4.1. During the injection operation, the band 6 is guided through an opening 4.2' formed in a plunger 4.2 (note particularly FIG. 4A), which places the leading end of the injected end section of the band 6, that has gotten under the anvil 4.1, against the underside of the anvil 4.1 (note FIG. 4C, for example). Thus, together with the plunger 4.2, the anvil 4.1 forms a clamping device for the leading end of the injected end section of the band 6.

After the leading end of the injected end section of the band 6 has been clamped, the drive of the injection device 5 is reversed and, therefore, the band 6 initially strapping the stack 2' loosely is tautened so that it nestles against the strapped surfaces of the stack 2".

Figure 4A:
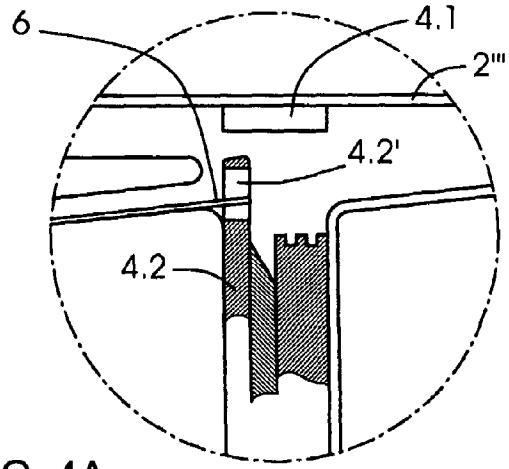
FIGS. 4A to 4F are enlarged, fragmentary views of FIG. 3 showing instantaneous images of the sequence of a banding or banderoling operation.
Figure 4B:
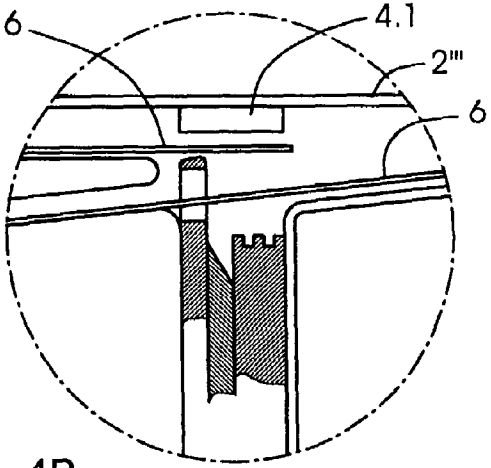
Figure 4C:
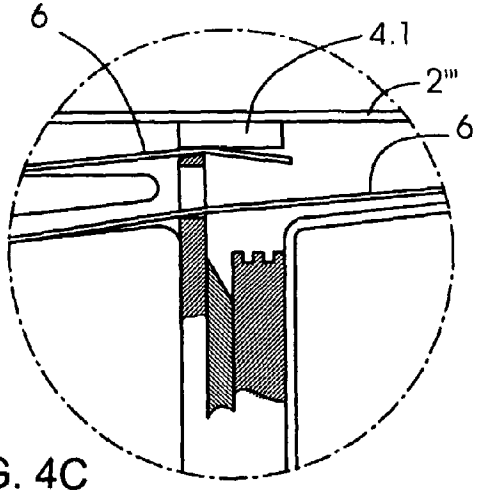
Figure 4D:
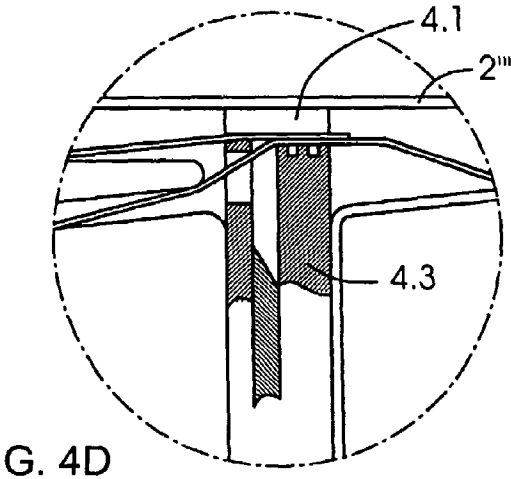

After this state has been reached, the reversed band drive 5' stops, and a welding bar 4.3 moves in a direction towards the underside of the anvil 4.1 and then welds sections of the band 6 pressed onto the anvil 4.1 with the welding bar 4.3 (note FIG. 4D).

Figure 4E:
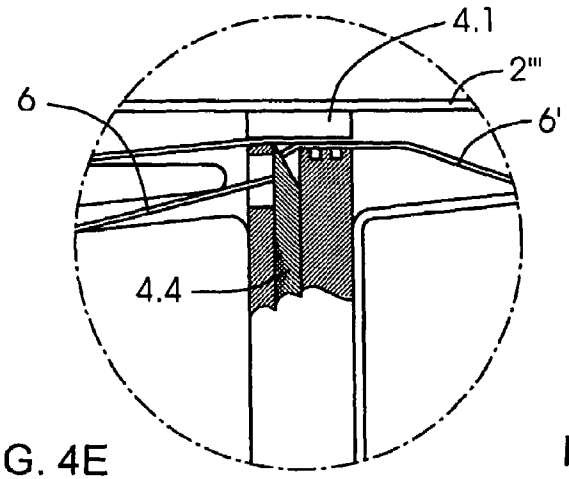
Figure 4F:
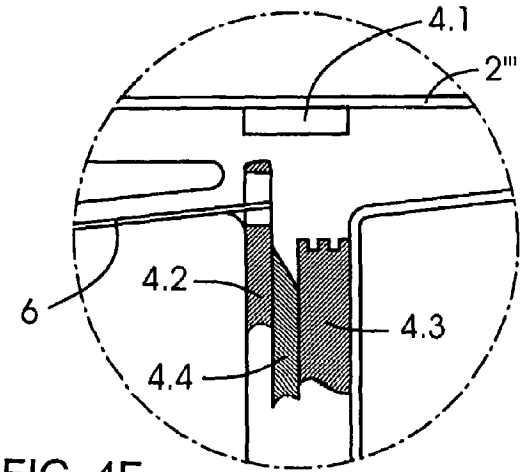

After the sections of the band 6 pressed onto the anvil 4.1 have been welded, a knife 4.4 moves in a direction towards the underside of the anvil 4.1 and separates a band 6', which is now closed and wrapped around the stack 2", from the band supply (note FIG. 4E).

After this operation has been completed, the plunger 4.2, the welding bar 4.3 and the knife 4.4 move back into the initial positions thereof. The free end of the band supply separated from the closed band 6' remains in the opening 4.2' in the plunger 4.2 for the next cycle.

After banding or banderoling has been performed, the anvil 4.1 is also withdrawn from the clamping, welding and cutting station again, the next stack 2" is displaced from the stacking station P into the banding or banderoling station B and the banded stack 2' is displaced from the banding or banderoling station B into a following station by temporarily or momentarily driving the endless conveyor 1. Thereafter, the anvil 4.1 is inserted into the banding or banderoling station B again, so that a state or phase according to FIG. 4A results.

The described equipment and sequences for creating a stack 2" provided with a band 6' result moreover advantageously in providing the bands 6' with only a single welded seam.

FIG. 3 illustrates a first alternative of the precautions, indicated at an earlier point and now explained, which are made in order to strap a respective stack 2" in the banding station B securely with the end section of the band 6 injected into the latter, although for this purpose a major part of this end section has to be guided above the stack 2". This alternative provides a pressure chamber 7 in order to form the already mentioned upper guide section 2.9 of the second band guide 2.11. This forms the upper guide section 2.9, together with a chamber wall 7.1 directed at least approximately downwardly. Provided in the chamber wall 7.1 are blower nozzles 7.2 from which, during operation, blast or blown air flows out with a directional component extending in the direction wherein the injected end section of the band 6 passes the chamber wall 7.1. The blower nozzles 7.2 are formed as slot nozzles, for example, and in total form a floating nozzle configuration 7.3, which holds that part of the injected section of the band 6 passing the chamber 7.1 in a floating position with respect to the chamber wall 7.1 under the action of the aerodynamic paradox.

Figure 5:
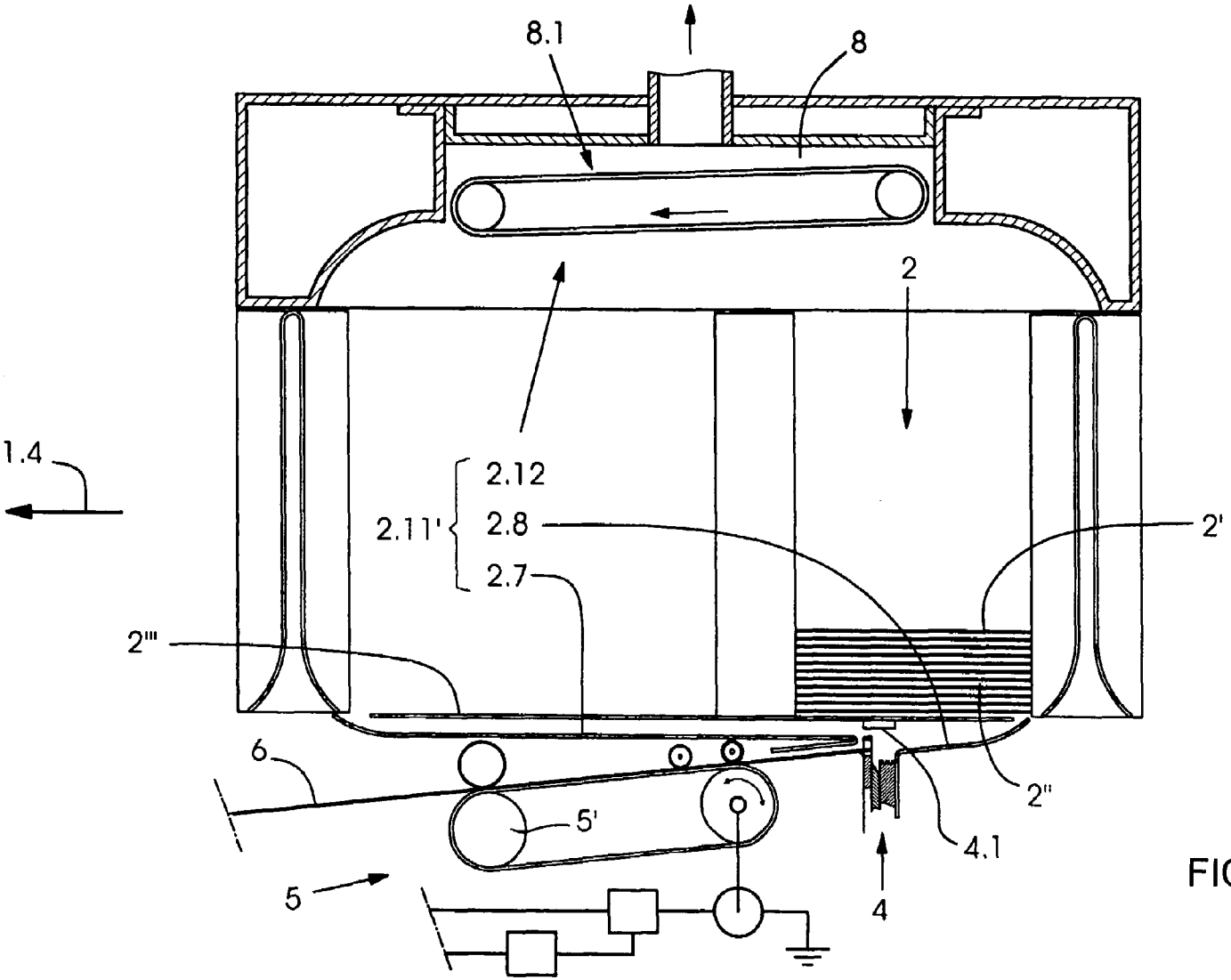
FIG. 5 is a view similar to that of FIG. 3 showing a second or alternative configuration of the intrinsically closed guide path.

A second alternative for the reliable guidance of the injected end section of the band 6 above the stack 2" to be strapped and then to be banded is shown in FIG. 5. In this regard, a second band guide 2.11' is provided forming an upper guide section 2.12 by a suction belt drive 8.1 operating in a vacuum chamber 8 which, in turn, is connected to a non-illustrated vacuum generator. The suction belt drive 8.1 includes, for example, depending upon the configuration thereof, one or more perforated belts or a given number of round belts. They respectively form a delivery strand which, in the case at hand, wherein the entry direction of the band 6 is into the interior of the respective stacking shaft 2, moves at least approximately in the conveying direction represented by the arrow 1.4 when in operation.

The configuration of the perforated belts or round belts and the configuration of the injection device 5 and, if appropriate, of the welding and cutting station 4 and also of the first band guide 2.10, in this regard, depend upon the number of blanks supplied to the respective stacking shaft 2.

For the case wherein the second band guide 2.11 includes the floating nozzle configuration 7.3 mentioned hereinbefore, if necessary or desirable, the configuration of the blast or blower nozzles thereof is also matched to the number of blanks supplied to the respective stacking shaft 2.

As indicated in FIG. 2, the preferred embodiment of the apparatus described hereinbefore has an auxiliary stack carrier 9 which is movable temporarily or momentarily over a respective one of the stacking shafts 2. This permits uninterrupted loading of the apparatus with the flat workpieces 2' which, in the present exemplary embodiment, is carried out by a feed belt configuration 10.

Depending upon the configuration thereof, the auxiliary stack carrier 9 is insertable manually or automatically between a last flat workpiece 2' to be deposited on the stack 2" and a flat workpiece 2' which follows thereafter, and temporarily or momentarily stores the flat workpieces 2' following the aforementioned last one until the endless conveyor 1, represented rather generally herein (in FIG. 2) and incompletely, has moved the finished stack 2" out of the stacking station P and into the banding or banderoling station B. Therefore, there is an empty stacking shaft 2 again in the stacking station P.

After this condition or state has been reached, the auxiliary stack carrier 9 is removed from the stack-forming area again, and the flat workpieces 2' which have accumulated on the auxiliary stack carrier 9 are transferred to the stack table 2"" (note FIG. 1).

Backing up the flat workpieces 2' temporarily on the feeder belt configuration 10, which is required in the embodiment without the auxiliary stack carrier 9, can thus be avoided. The cycle time of the apparatus explained herein is given at least approximately by the time required to pile up a respective stack 2". Added thereto is only the time required to displace a respective stacking shaft 2 from the stacking station P into the banding or banderoling station B. As a rule, i.e., beginning from a given number of flat workpieces 2' per stack 2", this is because the time required for banding or banderoling is shorter than that for piling up a respective stack 2".

As is also indicated in FIG. 2, a stop 11 for the leading edges of the flat workpieces 2' conveyed into the stacking station P is provided in the stacking station P. In a preferred embodiment, the stop 11 includes one or more tapes or belts revolving in such a manner that the leading edges of the flat workpieces 2' face towards strands which are moved downwardly.

As is only symbolically represented, the stop 11 is adjustable to the format of the delivered flat workpieces 2' and, for this purpose, is adjustable by a chain 11.1, for example.

The tapes or belts of the stop 11, revolving as explained, advantageously assist in the lowering of the flat workpieces 2' arriving in the stacking station P.

Furthermore, the lowering of the flat workpieces 2' which have arrived is promoted by a likewise downwardly moved strand of the feed belt configuration 10 which acts upon the trailing edge of the flat workpieces 2'.

This application claims the priority, under 35 U.S.C. § 119, of German Patent Application 10 2004 008 469.6, filed Feb. 20, 2004; the entire disclosure of the prior application is herewith incorporated by reference.

We claim:

1. An apparatus for forming stacks of flat workpieces and for banding or banderoling the stacks, the apparatus comprising:

a stacking station;

a banding or banderoling station;

an endless conveyor for cyclically conveying stacking shafts provided to said endless conveyor;

a respective first band guide formed on a respective one of the stacking shafts and including first and second guide sections, the first guide section directed in a conveyor direction, the second guide section directed opposite the conveying direction; and a second band guide disposed in said banding or banderoling station;

said second band guide together with said respective first band guide forming an at least approximately intrinsically closed guide path.

2. The apparatus according to claim 1, further comprising a reversible injection device associated with said banding or banderoling station for injecting an end section of a band into a respective stacking shaft located in said banding or banderoling station during operation.

3. The apparatus according to claim 2, further comprising a clamping, welding and cutting station associated with said banding or banderoling station, for clamping a free end of the injected end section in said clamping, welding and cutting station for reversed operation of said injection device.

4. The apparatus according to claim 1, wherein said second band guide is aligned at least approximately in a conveying direction of said endless conveyor.

5. The apparatus according to claim 1, wherein said second band guide includes a floating nozzle configuration.

6. The apparatus according to claim 1, wherein said second band guide includes a suction belt drive.

7. The apparatus according to claim 1, further comprising an auxiliary stack carrier temporarily movable over a respective one of said stacking shafts.

* * * * *